US010480526B2

(12) United States Patent
Nakashima et al.

(10) Patent No.: US 10,480,526 B2
(45) Date of Patent: Nov. 19, 2019

(54) AXIAL FLOW FAN AND AIR-CONDITIONING APPARATUS INCLUDING THE SAME

(71) Applicant: Mitsubishi Electric Corporation, Tokyo (JP)

(72) Inventors: Seiji Nakashima, Tokyo (JP); Takahide Tadokoro, Tokyo (JP); Shuhei Mizutani, Tokyo (JP); Yutaka Aoyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 145 days.

(21) Appl. No.: 15/756,085

(22) PCT Filed: Nov. 2, 2015

(86) PCT No.: PCT/JP2015/080884
§ 371 (c)(1),
(2) Date: Feb. 28, 2018

(87) PCT Pub. No.: WO2017/077564
PCT Pub. Date: May 11, 2017

(65) Prior Publication Data
US 2018/0238344 A1 Aug. 23, 2018

(51) Int. Cl.
*F04D 29/38* (2006.01)
*F04D 29/32* (2006.01)
(Continued)

(52) U.S. Cl.
CPC ..... *F04D 29/384* (2013.01); *F04D 29/325* (2013.01); *F04D 29/667* (2013.01);
(Continued)

(58) Field of Classification Search
CPC ..... F01D 5/141; F04D 29/544; F04D 29/324; F04D 29/325; F04D 29/667; F04D 29/384
See application file for complete search history.

(56) References Cited

U.S. PATENT DOCUMENTS 4,840,541 A * 6/1989 Sakane ..... F04D 29/384 415/119
6,027,307 A * 2/2000 Cho ..... F04D 29/164 415/173.5
(Continued)

FOREIGN PATENT DOCUMENTS

JP 2004-332674 A 11/2004
JP 2008-121552 A 5/2008
(Continued)

OTHER PUBLICATIONS

International Search Report of the International Searching Authority dated Feb. 9, 2016 for the corresponding international application No. PCT/JP2015/080884 (and English translation).

*Primary Examiner* — Carlos A Rivera
*Assistant Examiner* — Behnoush Haghighian
(74) *Attorney, Agent, or Firm* — Posz Law Group, PLC

(57) ABSTRACT

An axial flow fan according to the present invention includes a plurality of blades, each of the blades including: a leading edge formed in front in a direction of rotation of the axial flow fan; an inner circumferential edge formed at an inner circumference of the blades; and an outer circumferential edge formed at an outer circumference of the blades, the outer circumferential edge configured to be at downstream of a fluid, forced to move by the axial flow fan, than the inner circumferential edge, the blade being reflexed toward upstream of the fluid at a portion adjacent to the outer circumferential edge, and having a local angle-decrease section having a blade inlet angle α at the leading edge
(Continued)

decreasing from neighborhood, the local angle-decrease section being formed at a side of the leading edge and being located closer to the outer circumferential edge than to the inner circumferential edge.

6 Claims, 5 Drawing Sheets

(51) Int. Cl.
*F04D 29/66* (2006.01)
*F01D 5/14* (2006.01)
*F04D 29/54* (2006.01)

(52) U.S. Cl.
CPC ..... *F01D 5/141* (2013.01); *F04D 29/324* (2013.01); *F04D 29/544* (2013.01)

(56) References Cited

U.S. PATENT DOCUMENTS

| | | | | |
|---|---|---|---|---|
| 7,029,229 | B2 * | 4/2006 | Iwase | F04D 29/384 415/1 |
| 9,394,911 | B2 * | 7/2016 | Nakashima | F04D 29/384 |
| 9,605,686 | B2 * | 3/2017 | Hamada | F04D 29/384 |
| 2004/0253103 | A1 * | 12/2004 | Iwase | F04D 29/384 415/220 |
| 2013/0101420 | A1 | 4/2013 | Nakashima et al. | |
| 2015/0044058 | A1 | 2/2015 | Hamada et al. | |
| 2016/0348699 | A1 * | 12/2016 | Arai | F04D 19/002 |

FOREIGN PATENT DOCUMENTS

| | | | |
|---|---|---|---|
| JP | 2015-034503 | A | 2/2015 |
| WO | 2011/141964 | A1 | 11/2011 |
| WO | 2014/142225 | A1 | 9/2014 |
| WO | 2015/121989 | A1 | 8/2015 |

* cited by examiner

II-II CROSS-SECTIONAL VIEW

III-III CROSS-SECTIONAL VIEW

AXIAL FLOW FAN AND AIR-CONDITIONING APPARATUS INCLUDING THE SAME

CROSS REFERENCE TO RELATED APPLICATION

This application is a U.S. national stage application of PCT/JP2015/080884 filed on Nov. 2, 2015, the contents of which are incorporated herein by reference.

TECHNICAL FIELD

The present invention relates to an axial flow fan including a plurality of blades, and an air-conditioning apparatus including the axial flow fan.

BACKGROUND ART

An existing axial flow fan includes a plurality of blades along the circumferential surface of a cylindrical boss, and forces a fluid to move by the blades being rotated by rotary force provided to the boss. In the axial flow fan, the fluid present between the blades collides against the surfaces of the blades by rotation of the blades. At each surface against which the fluid collides, the pressure increases and pushes out and moves the fluid in the direction of the rotation axis about which the blades rotate.

In such an axial flow fan, to achieve a decrease in noise and an increase in efficiency, there is an example in which a backward-tilted blade that is tilted toward downstream relative to the flowflow direction of the fluid in a blade cross-section, in a radial direction, passing through the rotation axis of the blade, is used. In addition, there is an example in which an outer circumference reflexed portion (winglet) is formed in the neighborhood of the outer circumferential edge of a blade so as to be reflexed toward upstream relative to the flow direction of the fluid (see Patent Literature 1).

CITATION LIST

Patent Literature

Patent Literature 1: Japanese Unexamined Patent Application Publication No. 2015-34503

SUMMARY OF INVENTION

Technical Problem

In such an existing axial flow fan, an air current flows at the outer circumferential edge side of the blade from a pressure surface of the blade to a suction surface of the blade, thereby generating a spiral blade edge eddy. The blade edge eddy is formed at a distance from the suction surface of the blade. Accordingly, there is a problem in that the inflow air current flowing in from the leading edge of the blade collides against the blade edge eddy formed at the suction surface of the blade, whereby the air sending efficiency of the axial flow fan decreases, and noise is generated, for example.

The present invention has been made to solve such a problem of the axial flow fan, and an object of the present invention is to provide: an axial flow fan that inhibits an inflow air current flowing in from a leading edge of a blade from colliding against a blade edge eddy formed at a suction surface side of the blade and that achieves a decrease in noise and an increase in efficiency by causing the inflow air current to smoothly flow on the blade edge eddy; and an air-conditioning apparatus including the axial flow fan.

Solution to Problem

An axial flow fan according to an embodiment of the present invention includes a plurality of blades, each of the blades including a leading edge formed in front in a direction of rotation of the axial flow fan, an inner circumferential edge formed at an inner circumference of the blades, and an outer circumferential edge formed at an outer circumference of the blades, the outer circumferential edge being located at downstream in a flow direction of a fluid, forced to move by the axial flow fan, than the inner circumferential edge, the blade being reflexed toward upstream of the fluid at a portion adjacent to the outer circumferential edge, and having a local angle-decrease section having a blade inlet angle at the leading edge decreasing from neighborhood, the local angle-decrease section being formed at a side of the leading edge and being located closer to the outer circumferential edge than to the inner circumferential edge.

Advantageous Effects of Invention

In the axial flow fan according to the example of the present invention, by providing the local angle-decrease section having the blade inlet angle $\alpha$ decreasing from neighborhood, the local angle-decrease section being formed at the side of the blade and located closer to the outer circumferential edge at which there is influence of a blade edge eddy, a main air current flowing in from the leading edge of the blade stably flows on the blade edge eddy, whereby it is possible to achieve a decrease in noise and an increase in efficiency of the axial flow fan.

DESCRIPTION OF EMBODIMENTS

Embodiment 1

<Entire Configuration of Axial Flow Fan>

First, the entire configuration of an axial flow fan 100 according to Embodiment 1 will be described.

Figure 1:
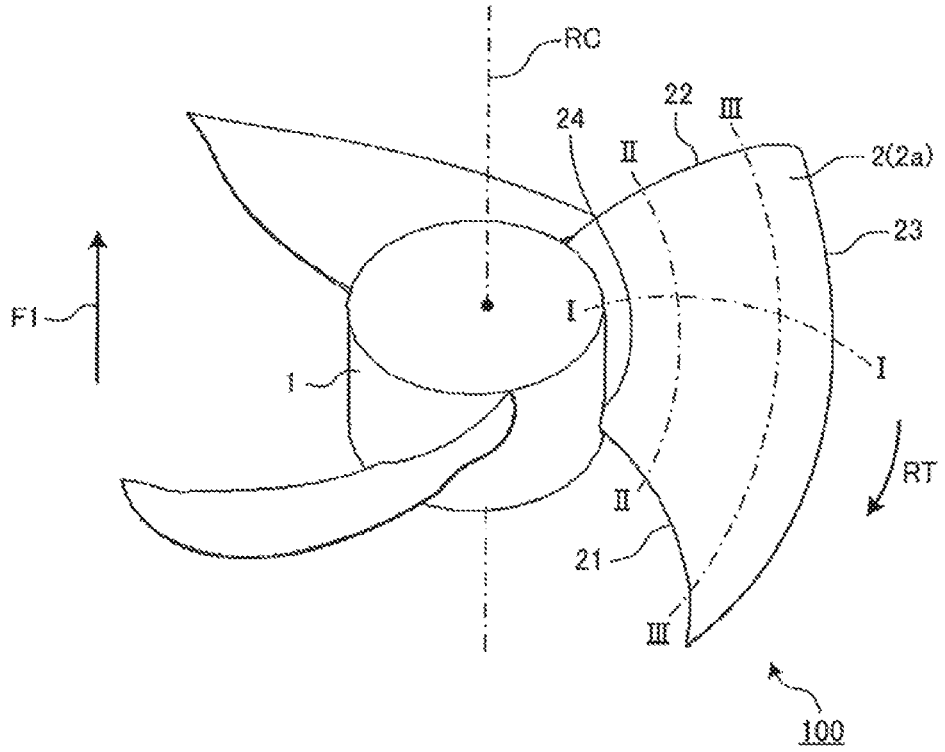
FIG. 1 is a perspective view of an axial flow fan according to Embodiment 1.

FIG. 1 is a perspective view of the axial flow fan according to Embodiment 1.

As shown in FIG. 1, the axial flow fan 100 according to Embodiment 1 includes: a cylindrical boss portion 1 disposed around a rotation axis RC serving as a central axis about which the axial flow fan 100 rotates; and a plurality of blades 2 disposed on the outer circumferential surface of the boss portion 1.

Each blade 2 is formed so as to be surrounded by: a leading edge 21 located in front in a direction of rotation RT; a trailing edge 22 located in back in the direction of rotation RT; an outer circumferential edge 23 forming an outer periphery; and an inner circumferential edge 24 forming an inner periphery.

As shown in FIG. 1, the leading edge 21 is formed so as to connect the outer circumferential surface of the boss portion 1 to the outer circumferential edge 23 and has an arc shape that is concave toward the direction of rotation RT.

Similarly, as shown in FIG. 1, the trailing edge 22 is formed so as to connect the outer circumferential surface of the boss portion 1 to the outer circumferential edge 23 and has an arc shape that is convex toward the direction opposite to the direction of rotation RT.

The outer circumferential edge 23 is formed so as to connect the outer end of the leading edge 21 to the outer end of the trailing edge 22 and is located substantially on a circumference having a center at the rotation axis RC. The blade chord length of the blade 2 is the longest in the neighborhood of the outer circumferential edge 23.

Each blade 2 is formed so as to be tilted at a predetermined angle relative to the rotation axis RC. Each blade 2 presses a fluid present between the blades 2, with a blade surface thereof, with rotation of the axial flow fan 100, to force the fluid to flow in a flow direction F1 of the fluid. At this time, the surface that presses the fluid to increase the pressure, of the blade surfaces, is referred to as pressure surface 2*a*, and the surface that is a back surface of the pressure surface 2*a* and on which the pressure decreases is referred to as suction surface 2*b* (see FIG. 2 described later).

Figure 2:
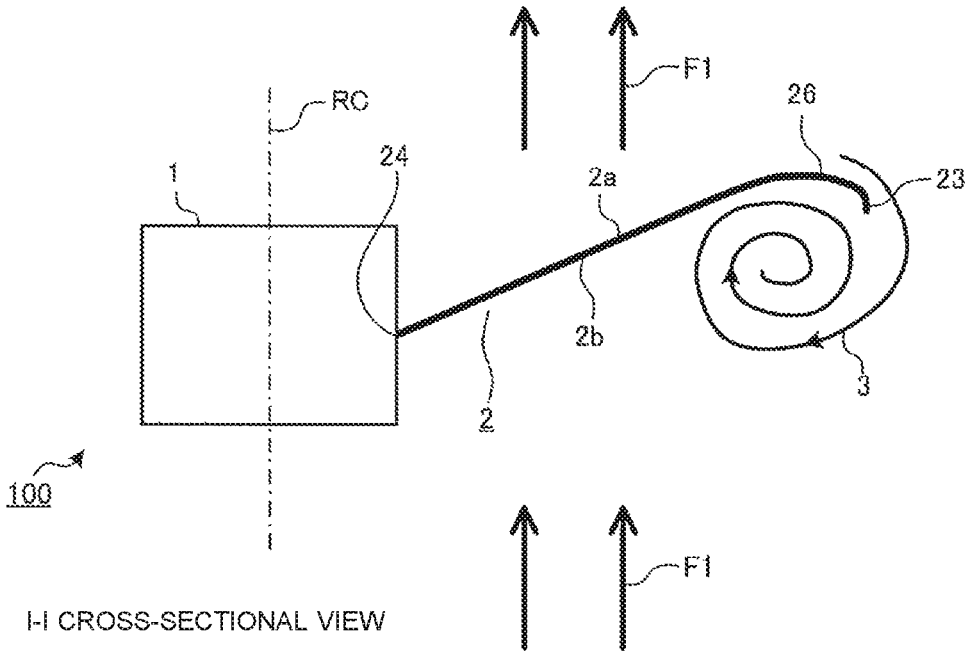
FIG. 2 is a cross-sectional view of a blade according to Embodiment 1 in a radial direction (I-I) in FIG. 1.

FIG. 2 is a cross-sectional view of the blade according to Embodiment 1 in a radial direction (I-I) in FIG. 1.

The blade 2 of the axial flow fan 100 according to Embodiment 1 is formed as a backward-tilted blade that is tilted toward downstream relative to the flow direction F1 of the fluid in the radial direction of the blade 2 in a cross-sectional shape of the blade 2 as shown in FIG. 2. An outer circumference reflexed portion 26 is formed in the neighborhood of the outer circumferential edge 23 of the blade 2 so as to be reflexed toward upstream relative to the flow direction F1 of the fluid. Accordingly, at the outer circumferential edge 23 side of the blade 2, an air current smoothly flows in from the pressure surface 2*a* of the blade 2 to the suction surface 2*b* to generate a spiral blade edge eddy 3.

<Configuration of Leading Edge 21 at Inner Circumferential Edge 24 Side>

Next, a mount angle of the leading edge 21 at the inner circumferential edge 24 side of the blade 2 will be described with reference to a blade chord direction cross-sectional view shown in FIG. 3.

Figure 3:
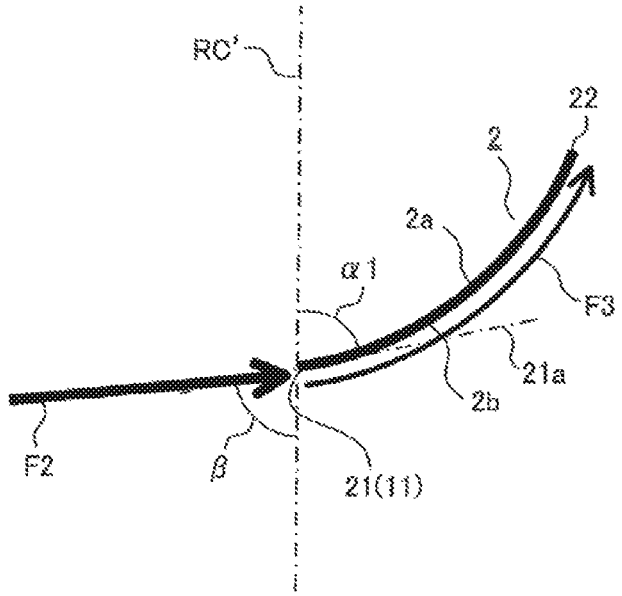
FIG. 3 is a cross-sectional view of the blade according to Embodiment 1 in a blade chord direction (II-II) in FIG. 1.

FIG. 3 is a cross-sectional view of the blade according to Embodiment 1 in a blade chord direction (II-II) in FIG. 1.

The tangent line to the suction surface 2*b* at the leading edge 21 of the blade 2 is referred to as leading edge tangent line 21*a*, a straight line parallel to the rotation axis RC is referred to as axial imaginary line RC', and the angle formed by the leading edge tangent line 21*a* and the axial virtual line RC' is referred to as blade inlet angle $\alpha$. In addition, the blade inlet angle $\alpha$ at an inner circumferential side leading edge 11 that is the inner circumferential edge 24 side of the leading edge 21 is particularly referred to as blade inlet angle $\alpha$1. In addition, the angle formed by an inflow air current F2 and the axial virtual line RC' is referred to as inflow angle $\beta$.

In this case, as shown in FIG. 3, at the inner circumferential side leading edge 11, the inflow angle $\beta$ and the blade inlet angle $\alpha$1 are set so as to be substantially equal to each other. Therefore, at the inner circumferential side leading edge 11, the inflow air current F2 flowing in to the suction surface 2*b* of the blade 2 forms a main air current F3 smoothly flowing along the suction surface 2*b*.

<Configuration of Leading Edge 21 at Outer Circumferential Edge 23 Side>

Next, a mount angle of the leading edge 21 at the outer circumferential edge 23 side of the blade 2 will be described with reference to a blade chord direction cross-sectional view shown in FIG. 4.

Figure 4:
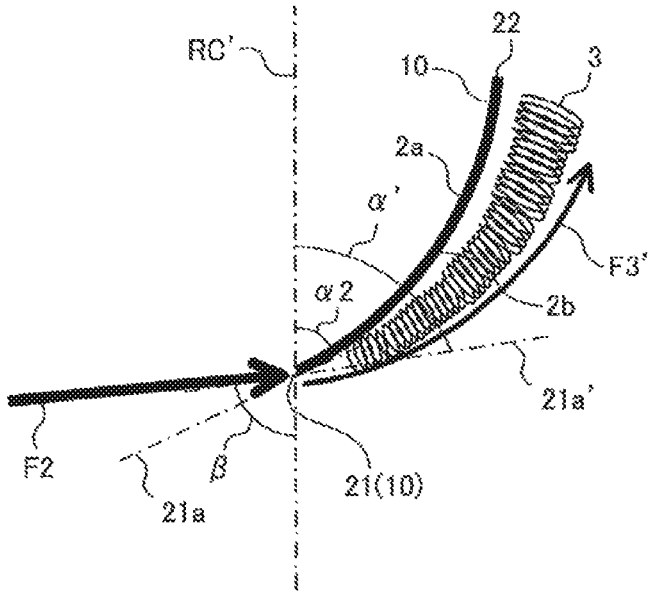
FIG. 4 is a cross-sectional view of the blade according to Embodiment 1 in a blade chord direction (III-III) in FIG. 1.

FIG. 4 is a cross-sectional view of the blade according to Embodiment 1 in a blade chord direction (III-III) in FIG. 1.

Similarly to the cross-sectional view at the inner circumferential edge 24 side of the blade 2 in FIG. 3, the tangent line to the suction surface 2*b* at the leading edge 21 of the blade is referred to as leading edge tangent line 21*a*, a straight line parallel to the rotation axis RC is referred to as axial virtual line RC', and the angle formed by the leading edge tangent line 21*a* and the axial virtual line RC' is referred to as blade inlet angle $\alpha$2. In addition, the angle formed by the inflow air current F2 and the axial virtual line RC' is referred to as inflow angle $\beta$.

In this case, the blade inlet angle $\alpha$2 of the leading edge 21 at the outer circumferential edge 23 side of the blade 2 is set so as to be smaller than the blade inlet angle $\alpha$1 of the leading edge 21 at the inner circumferential edge 24 side of the blade 2. A region where the leading edge 21 is formed at the blade inlet angle $\alpha$2 is defined as local angle-decrease section 10. The boundary between the blade inlet angle $\alpha$1 of the inner circumferential side leading edge 11 of the blade 2 and the blade inlet angle $\alpha$2 in the local angle-decrease section 10 is set, for example, at an intermediate position in the radial length of the blade 2 shown in FIG. 2.

Advantageous Effects

As described above, each blade 2 is shaped as a backward-tilted blade that is tilted toward downstream relative to the flow direction F1 of the fluid as coming closer to the outer circumferential edge 23, and the outer circumference reflexed portion 26 is formed in the neighborhood of the outer circumferential edge 23 so as to be reflexed toward upstream relative to the flow direction F1.

Accordingly, the flow rate or the magnitude of the eddy diameter of the blade edge eddy 3 is reduced as compared to that in the case where the blade 2 is shaped as a forward-tilted blade, and an air current smoothly flows in from the pressure surface 2*a* of the blade 2 to the suction surface 2*b* of the blade 2 due to the outer circumference reflexed portion 26, to generate the spiral blade edge eddy 3 as shown in FIG. 2 or FIG. 4.

Due to such a configuration of the blade 2, the blade edge eddy 3 is stably formed, and is also formed at a distance from the suction surface 2*b* of the blade 2. Therefore, pressure fluctuations on the suction surface 2*b* of the blade 2 are reduced, so that it is possible to achieve a decrease in noise and a reduction in power consumption of the axial flow fan 100.

As described above, since the blade 2 is shaped as a backward-tilted blade and has the outer circumference reflexed portion 26, the blade edge eddy 3 is formed at a distance from the suction surface 2*b* of the blade 2, and thus it is possible to achieve a decrease in noise and a reduction in power consumption of the axial flow fan 100. A main air current F3' flowing in from the leading edge 21 of the blade 2 flows beyond the blade edge eddy 3 as shown in FIG. 4.

Accordingly, the inflow angle β of the inflow air current F2 flowing in from the leading edge 21 and the blade inlet angle α2 of the leading edge 21 become hard to be equal to each other due to influence of the blade edge eddy 3 formed at a distance from the suction surface 2*b* of the blade 2. The angle formed by the axial virtual line RC' and an inflow direction 21*a*' of the main air current F3' at the leading edge 21 of the blade 2 is referred to as main air current angle α'.

Thus, by providing the local angle-decrease section 10 having the blade inlet angle α2 decreasing from neighborhood so as to be smaller than the blade inlet angle α1 of the inner circumferential side leading edge 11, the local angle-decrease section 10 being formed at the side of the blade 2 and located closer to the outer circumferential edge 23 at which there is influence of the blade edge eddy 3, it is possible to make the main air current angle α' and the inflow angle β substantially equal to each other as shown in FIG. 4. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

Embodiment 2

In Embodiment 1, the example has been described in which the blade inlet angle α2 of the leading edge 21 at the outer circumferential edge 23 side of the blade 2 is formed so as to be smaller than the blade inlet angle α1 of the leading edge 21 at the inner circumferential edge 24 side of the blade 2. Embodiment 2 is different from Embodiment 1 in that the shape of the local angle-decrease section 10 having the blade inlet angle α2 is specified. The other basic configuration of the axial flow fan 100 is the same as in Embodiment 1, and thus the description thereof is omitted.

Change of the blade inlet angle α of the leading edge 21 of the blade 2 according to Embodiment 2 in the radial direction will be described with reference to FIGS. 5 and 6.

Figure 5:
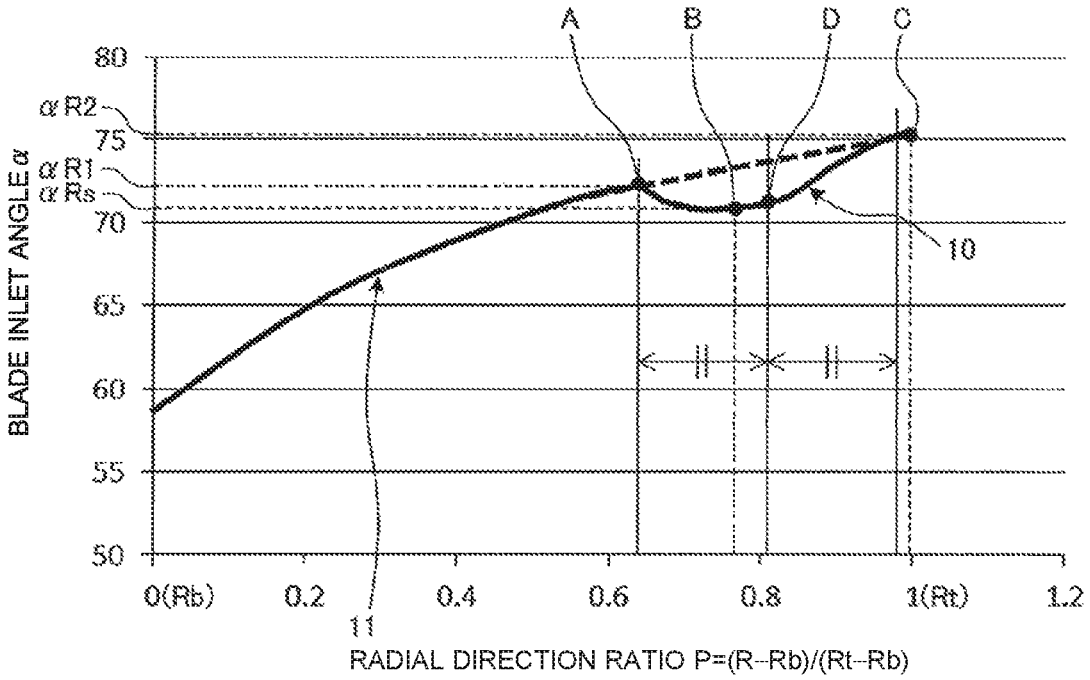
FIG. 5 is an explanatory diagram showing change of a blade inlet angle $\alpha$ in a radial direction according to Embodiment 2.

FIG. 5 is an explanatory diagram showing the change of the blade inlet angle α according to Embodiment 2 in the radial direction.

Figure 6:
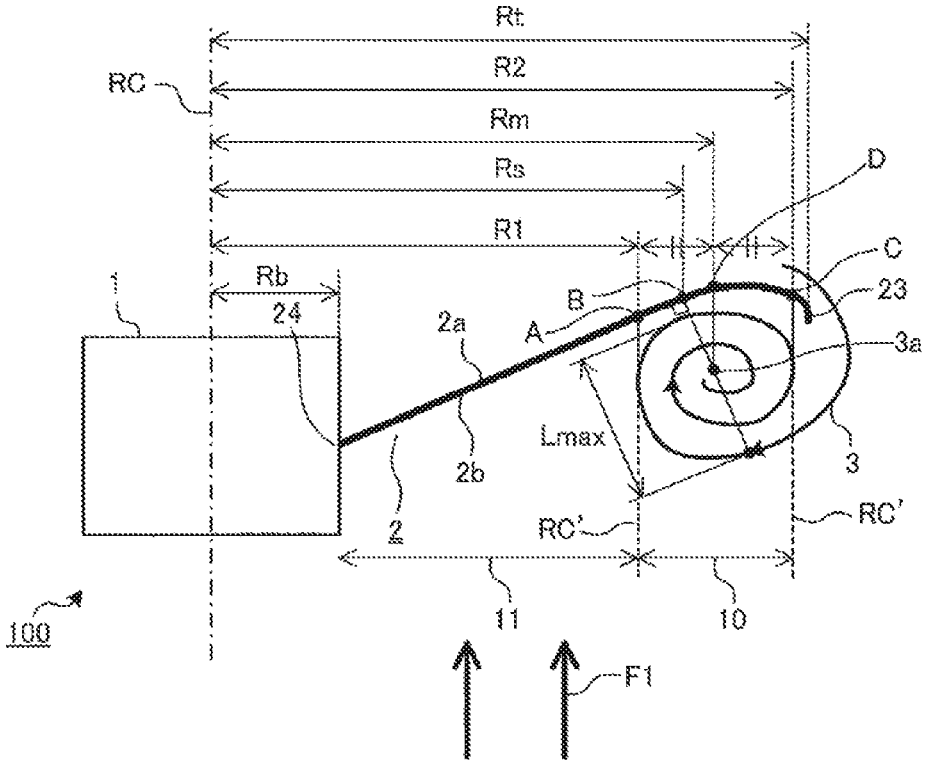
FIG. 6 is a cross-sectional view, of a blade according to Embodiment 2, passing through a rotation axis RC.

FIG. 6 is a cross-sectional view, of the blade according to Embodiment 2, passing through the rotation axis RC.

On the horizontal axis, a radial direction ratio P=(R−Rb)/(Rt−Rb) is used as a parameter indicating a target position for the blade inlet angle α. Here, each variable is as follows.

R: radial length from the rotation axis RC to a target position for the blade inlet angle α.

Rb: radial length of the boss portion 1 represented by the distance from the rotation axis RC to the outer circumferential surface of the boss portion 1.

Rt: maximum radial length from the rotation axis RC to the outer circumferential edge 23 of the blade 2.

The blade inlet angle α increases as the radial direction ratio P=(R−Rb)/(Rt−Rb) moves and increases from the inner circumferential edge 24 of the blade 2 (the outer circumferential surface of the boss portion 1), at which the radial direction ratio P=(R−Rb)/(Rt−Rb) is P=0 (R=Rb), toward the outer circumferential edge 23.

When a curve of the blade inlet angle α at this time is obtained as a function of the radial direction ratio P, the curve of blade inlet angle α is represented, for example, as the following equation (1).

[Math. 1]

$$\alpha = A*P3 - B*P2 + C*P + D \quad (1)$$

A to D are positive coefficients.

The blade inlet angle α has the local angle-decrease section 10 in which the value of the blade inlet angle α decreases from neighborhood, at the outer circumferential edge 23 of the blade 2 at which the radial direction ratio P=(R−Rb)/(Rt−Rb) is P=1.0 (R=Rt).

The local angle-decrease section 10 is formed as a section of the radial direction ratio P in which the blade inlet angle α is away downward from the curve of the above equation (1) as shown in FIG. 5.

Thus, the local angle-decrease section 10 has a first point of intersection A at one end side thereof and a second point of intersection C at the other end side thereof, as a point away downward from the curve of the equation (1). At this time, at the first point of intersection A, the blade inlet angle α=αR1, and the radial length R is R1 as shown in FIG. 6.

In addition, the local angle-decrease section 10 has a minimum point B at which the blade inlet angle α decreasing from the blade inlet angle α=αR1 at the first point of intersection A toward the outer circumferential edge 23 changes to increase again. At this time, at the minimum point B, the blade inlet angle α=αRs, and the radial length R is Rs as shown in FIG. 6.

Then, the local angle-decrease section 10 has the second point of intersection C at which the blade inlet angle α increasing from the blade inlet angle α=αRs at the minimum point B intersects the curve of the equation (1) again. At this time, at the second point of intersection C, the blade inlet angle α=αR2, and the radial length R is R2 as shown in FIG. 6.

The local angle-decrease section 10 also has an intermediate point D at which the radial length R=Rm that is the intermediate between R1 and R2.

Thus, the local angle-decrease section 10 is formed at the leading edge 21 of the blade 2 so as to start from the radial length R=R1 at the first point of intersection A, pass through the radial length R=Rs at the minimum point B, and reach the radial length R=R2 at the second point of intersection C. That is, the local angle-decrease section 10 is formed with the first point of intersection A and the second point of intersection C as both ends thereof.

The local angle-decrease section 10 of the blade inlet angle α according to Modification 2 of Embodiment 2 is formed such that the radial length R=Rs at the minimum point B is shorter than the radial length R=Rm at the intermediate point D and the minimum point B is located closer to the inner circumferential edge 24 than the intermediate point D, as shown in FIGS. 5 and 6.

Advantageous Effects

The advantageous effects achieved by the above-described configuration will be described with reference to FIG. 6.

As shown in FIG. 6, the local angle-decrease section 10 of the blade inlet angle α is formed at the leading edge 21 of the blade 2 so as to start from the radial length R=R1 at the first point of intersection A, pass through the radial length R=Rs the minimum point B and the radial length R=Rm at the intermediate point D, and reach the radial length R=R2 at the second point of intersection C, in order from the inner circumferential edge 24.

Accordingly, as shown in FIG. 6, the positions of the radial length R=R1 and R=R2 are each set so as to intersect the axial virtual line RC', which is tangent to the outer diameter of the blade edge eddy 3.

Here, since the blade 2 according to Embodiment 2 is a backward-tilted blade, the position of a perpendicular line from the center 3*a* of the blade edge eddy 3 to the suction surface 2*b* at which position the eddy diameter of the blade edge eddy 3 becomes a maximum value Lmax, is geometrically closer to the inner circumferential edge 24 than the position at which the radial length R=Rm.

That is, by making the blade inlet angle α have a minimum at the radial length R=Rs that is smaller than the radial length R=Rm at the intermediate point D, the position at which the eddy diameter of the blade edge eddy 3 is the maximum value Lmax and the position at which the blade inlet angle α has the minimum substantially coincide with each other.

Therefore, even at the radial length R of the blade 2 at which the eddy diameter of the blade edge eddy 3 is the maximum value Lmax, it is possible to make the main air current angle α' and the inflow angle β shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

<Modification 1 of Embodiment 2>

Figure 7:
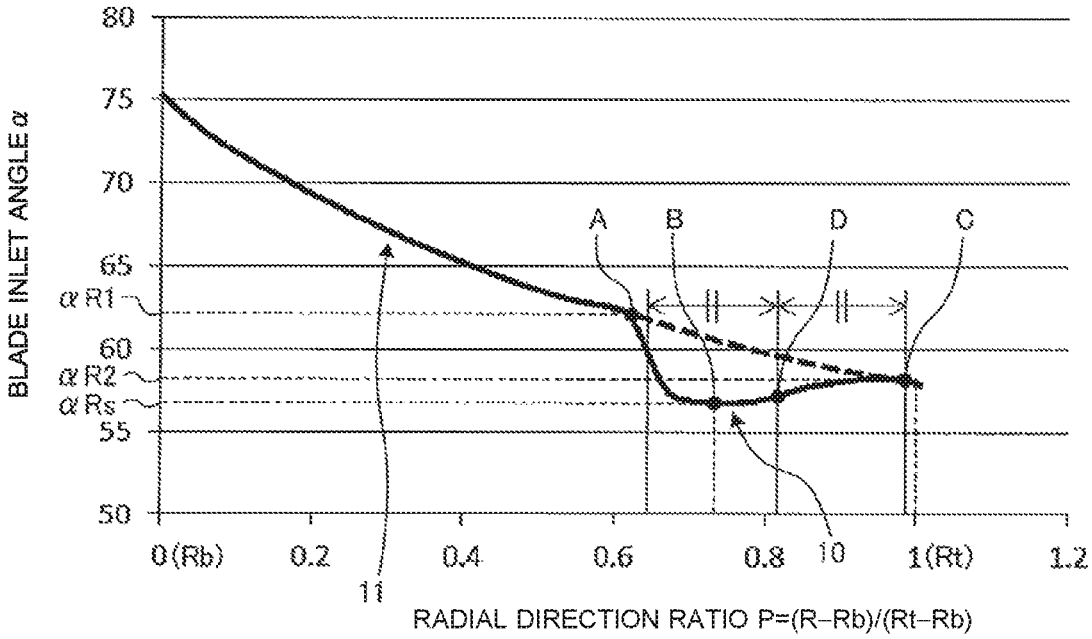
FIG. 7 is an explanatory diagram showing change of a blade inlet angle $\alpha$ according to Modification 1 of Embodiment 2 in a radial direction.

FIG. 7 is an explanatory diagram showing change of the blade inlet angle α according to Modification 1 of Embodiment 2 in the radial direction.

In the axial flow fan 100 according to Embodiment 2, the curve of the blade inlet angle α is represented as a function of the radial direction ratio P by the above equation (1) in which the blade inlet angle α also increases as the radial direction ratio P increases. In the axial flow fan 100 according to Modification 1, the curve of the blade inlet angle α is formed by the following equation (2) in which the blade inlet angle α decreases as the radial direction ratio P increases. The other configuration of the axial flow fan 100 is the same as in Embodiment 2.

[Math. 2]

$$\alpha=-E*P3+F*P2-G*P+H \quad (2)$$

E to H are positive coefficients.

The curve of the equation (2) indicating change of the blade inlet angle α is formed such that the blade inlet angle α decreases as the radial direction ratio P increases as shown in FIG. 7.

Similarly to Embodiment 2, the blade inlet angle α has a local angle-decrease section 10 in which the value of the blade inlet angle α decreases from neighborhood, at the outer circumferential edge 23 of the blade 2 at which the radial direction ratio P is P=1.0 (R=Rt).

The local angle-decrease section 10 is formed as a section of the radial direction ratio P in which the blade inlet angle α is away downward from the curve of the above equation (2) as shown in FIG. 7.

Thus, the local angle-decrease section 10 has a first point of intersection A at one end side thereof and a second point of intersection C at the other end side thereof, as a point away downward from the curve of the equation (2). At this time, at the first point of intersection A, the blade inlet angle α=αR1, and the radial length R is R1 as shown in FIG. 6.

In addition, the local angle-decrease section 10 has a minimum point B at which the blade inlet angle α decreasing from the blade inlet angle α=αR1 at the first point of intersection A toward the outer circumferential edge 23 changes to increase again. At this time, at the minimum point B, the blade inlet angle α=αRs, and the radial length R is Rs as shown in FIG. 6.

Then, the local angle-decrease section 10 has the second point of intersection C at which the blade inlet angle α increasing from the blade inlet angle α=αRs at the minimum point B intersects the curve of the equation (2) again. At this time, at the second point of intersection C, the blade inlet angle α=αR2, and the radial length R is R2 as shown in FIG. 6.

The local angle-decrease section 10 also has an intermediate point D at which the radial length R=Rm that is the intermediate between R1 and R2.

Thus, the local angle-decrease section 10 is formed at the leading edge 21 of the blade 2 so as to start from the radial length R=R1 at the first point of intersection A, pass through the radial length R=Rs at the minimum point B, and reach the radial length R=R2 at the second point of intersection C. That is, the local angle-decrease section 10 is formed with the first point of intersection A and the second point of intersection C as both ends thereof.

The local angle-decrease section 10 of the blade inlet angle α according to Modification 2 of Embodiment 2 is formed such that the radial length R=Rs at the minimum point B is shorter than the radial length R=Rm at the intermediate point D and the minimum point B is located closer to the inner circumferential edge 24 than the intermediate point D, as shown in FIGS. 6 and 7.

Advantageous Effects

The advantageous effects of the axial flow fan 100 according to Modification 1 of Embodiment 2 are the same as the advantageous effects of the axial flow fan 100 according to Embodiment 2.

That is, by making the blade inlet angle α have a minimum at the radial length R=Rs that is smaller than the radial length R=Rm at the intermediate point D, the position at which the eddy diameter of the blade edge eddy 3 is the maximum value Lmax and the position at which the blade inlet angle α has the minimum substantially coincide with each other.

Therefore, even at the radial length R of the blade 2 at which the eddy diameter of the blade edge eddy 3 is the maximum value Lmax, it is possible to make the main air current angle α' and the inflow angle β shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

<Modification 2 of Embodiment 2>

Figure 8:
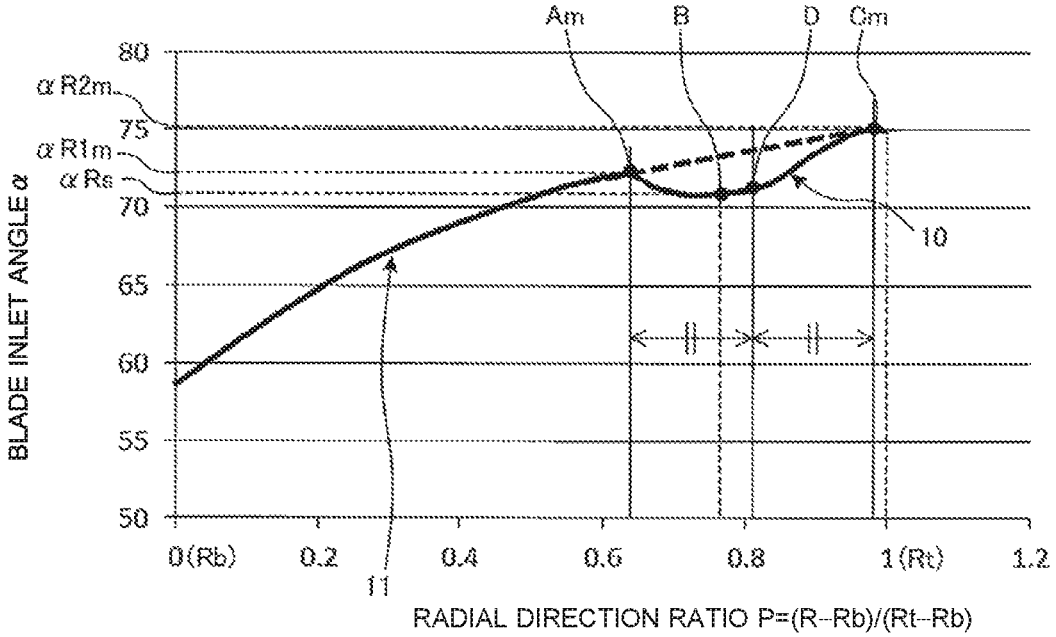
FIG. 8 is an explanatory diagram showing change of a blade inlet angle $\alpha$ according to Modification 2 of Embodiment 2 in a radial direction.

FIG. 8 is an explanatory diagram showing change of the blade inlet angle α according to Modification 2 of Embodiment 2 in the radial direction.

Modification 2 is different from Embodiment 2 and Modification 1 thereof in that: in the axial flow fan 100 according to Embodiment 2 and Modification 1 thereof, both ends of the local angle-decrease section 10 are defined as the points of intersection of the curves of the equation (1) and the equation (2); and in the axial flow fan 100 according to Modification 2, both ends of the local angle-decrease section 10 are defined as two maximum points on a curve. The other configuration of the axial flow fan 100 is the same as in Embodiment 2.

The local angle-decrease section 10 according to Modification 2 has a first maximum point Am at which the blade inlet angle α continuously increasing from the inner circumferential edge 24 of the blade 2 (the outer circumferential surface of the boss portion 1) at which the radial direction ratio P=(R−Rb)/(Rt−Rb) is P=0 (R=Rb) changes to decrease as shown in FIG. 8. At this time, at the first maximum point Am, the blade inlet angle α=αR1*m*, and the radial length R is R1.

In addition, the local angle-decrease section 10 has a minimum point B at which the blade inlet angle α decreasing from the first maximum point Am changes to increase again. At this time, at the minimum point B, the blade inlet angle α=αRs, and the radial length R is Rs.

Then, the local angle-decrease section 10 has a second maximum point Cm that is a point at which the blade inlet angle α increasing from the minimum point B changes to decrease again. At this time, at the second maximum point Cm, the blade inlet angle α=αR2*m*, and the radial length R is R2.

The local angle-decrease section 10 also has an intermediate point D at which the radial length R=Rm that is the intermediate between R1 and R2.

Thus, the local angle-decrease section 10 is formed at the leading edge 21 of the blade 2 so as to start from the radial length R=R1 at the first maximum point Am, pass through the radial length R=Rs at the minimum point B, and reach the radial length R=R2 at the second maximum point Cm. That is, the local angle-decrease section 10 is formed with the first maximum point Am and the second maximum point Cm as both ends thereof.

The local angle-decrease section 10 of the blade inlet angle α according to Modification 2 of Embodiment 2 is formed such that the radial length R=Rs at the minimum point B is shorter than the radial length R=Rm at the intermediate point D and the minimum point B is located closer to the inner circumferential edge 24 than the intermediate point D, as shown in FIG. 8.

Advantageous Effects

The advantageous effects of the axial flow fan 100 according to Modification 2 of Embodiment 2 are the same as the advantageous effects of the axial flow fan 100 according to Embodiment 2.

That is, by making the blade inlet angle α have a minimum at the radial length R=Rs that is smaller than the radial length R=Rm at the intermediate point D, the position at which the eddy diameter of the blade edge eddy 3 is the maximum value Lmax and the position at which the blade inlet angle α has the minimum substantially coincide with each other.

Therefore, even at the radial length R of the blade 2 at which the eddy diameter of the blade edge eddy 3 is the maximum value Lmax, it is possible to make the main air current angle α' and the inflow angle β shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

Embodiment 3

Embodiment 3 is different from Embodiment 2 in that in the axial flow fan 100 according to Embodiment 2, the local angle-decrease section 10 of the blade 2 is specified to have the minimum point B, but in Embodiment 3, the position, in the radial direction, of the minimum point B is specified. The other basic configuration of the axial flow fan 100 is the same as in Embodiments 1 and 2, and thus the description thereof is omitted.

In the local angle-decrease section 10 formed at the leading edge 21 of the blade 2, the radial length Rs at the minimum point B at which the blade inlet angle α is at its minimum is set so as to satisfy 0.1<(Rt−Rs)/(Rt−Rb)<0.5 when a radial length of the boss portion 1 represented by the distance from the rotation axis RC to the outer circumferential surface of the boss portion 1 is denoted by Rb and the maximum radial length from the rotation axis RC to the outer circumferential edge 23 of the blade 2 is denoted by Rt.

Advantageous Effects

In the axial flow fan 100 according to Embodiment 3, since the radial length Rs at the minimum point B at which the blade inlet angle α of the leading edge 21 is at its minimum is set so as to satisfy 0.1<(Rt−Rs)/(Rt−Rb)<0.5, the range of the local angle-decrease section 10 in which the blade inlet angle α decreases substantially coincides with the position at which the blade edge eddy 3 occurs.

Therefore, it is possible to make the main air current angle α' of the main air current F3' and the inflow angle β of the blade 2 shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

Embodiment 4

Figure 9:
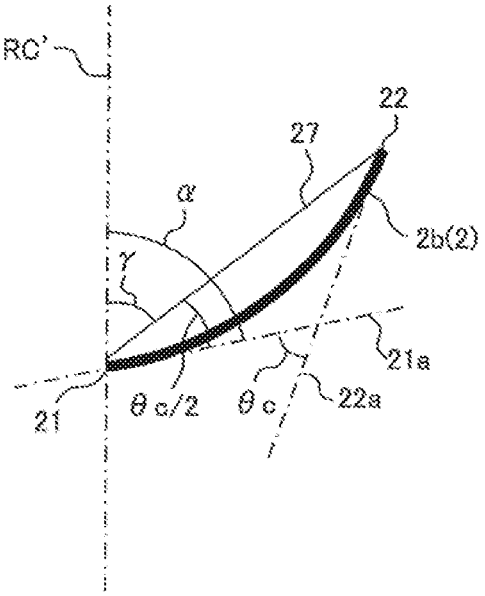
FIG. 9 is a cross-sectional view of an axial flow fan according to Embodiment 4 in the blade chord direction (II-II) in FIG. 1.

FIG. 9 is a cross-sectional view of an axial flow fan according to Embodiment 4 in the blade chord direction (II-II) in FIG. 1.

The axial flow fan 100 according to Embodiment 4 is different from the axial flow fan 100 according to Embodiments 1 to 3 in that the blade cross-section of the axial flow fan 100 according to Embodiments 1 to 3 is specified. The other configuration is the same as that of the axial flow fan 100 according to Embodiments 1 to 3, and thus the description thereof is omitted.

As shown in FIG. 9, the cross-sectional shape of the blade 2 is an arc shape in the cross-sectional view of the blade 2 in the blade chord direction.

The tangent line to the suction surface 2*b* at the leading edge 21 of the blade 2 is referred to as leading edge tangent line 21*a*, a straight line parallel to the rotation axis RC is referred to as axial virtual line RC', and the angle formed by the leading edge tangent line 21*a* and the axial virtual line RC' is referred to as blade inlet angle α.

The angle formed by the axial virtual line RC' and a blade chord 27 connecting the leading edge 21 and the trailing edge 22 is referred to as stagger angle γ.

Furthermore, the acute angle at the point of intersection of the leading edge tangent line 21*a* to the suction surface 2*b* at the leading edge 21 of the blade 2 and a trailing edge tangent line 22*a* to the suction surface 2*b* at the trailing edge 22 is referred to as camber angle θc.

In this case, the blade inlet angle α of the blade 2 according to Embodiment 4 is set so as to satisfy $\alpha=\gamma+\theta c/2$.

Advantageous Effects

Since the blade 2 of the axial flow fan 100 according to Embodiment 4 has an arc cross-sectional shape in which the blade inlet angle α satisfies $\alpha=\gamma+\theta c/2$ as described above, the surface of the blade 2 becomes smooth, so that the blade edge eddy 3 generated at the suction surface 2*b* of the blade 2 becomes stable. Accordingly, as shown in FIG. 4, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

It is possible to combine the respective configurations of the axial flow fans 100 according to Embodiments 1 to 4 described above. Due to the synergetic effects of these configurations, as shown in FIG. 4, the main air current F3' flowing in from the leading edge 21 of the blade 2 becomes more stable on the blade edge eddy 3, and pressure loss is reduced, whereby it is possible to achieve a decrease in noise and an increase in efficiency of the axial flow fan 100.

(Application to Air-Conditioning Apparatus)

It is possible to use the axial flow fan 100 according to Embodiments 1 to 4 described above, for example, as an air-sending device that sends air for heat exchange to an indoor heat exchanger or an outdoor heat exchanger of an air-conditioning apparatus.

Figure 10:
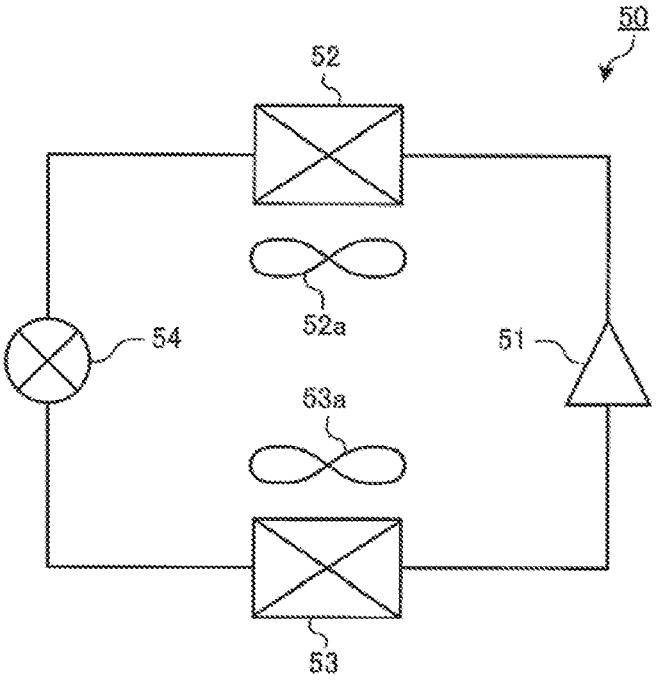
FIG. 10 is a schematic diagram of an air-conditioning apparatus in which the axial flow fan according to Embodiments 1 to 4 is used.

FIG. 10 is a schematic diagram of an air-conditioning apparatus in which the axial flow fan according to Embodiments 1 to 4 is used.

The air-conditioning apparatus includes a refrigeration cycle device 50 shown in FIG. 10. The refrigeration cycle device 50 is configured by sequentially connecting a compressor 51, a condenser 52, an expansion valve 54, and an evaporator 53 by refrigerant pipes. A condenser fan 52*a* that sends air for heat exchange to the condenser 52 is disposed at the condenser 52. In addition, an evaporator fan 53*a* that sends air for heat exchange to the evaporator 53 is disposed at the evaporator 53.

By using the axial flow fan 100 according to Embodiments 1 to 4 in such an air-conditioning apparatus, the air-sending efficiency of the condenser fan 52*a* or the evaporator fan 53*a* improves, so that it is possible to improve the cooling/heating performance of the air-conditioning apparatus.

It is also possible to use the axial flow fan 100 according to Embodiments 1 to 4 described above, as a ventilator, an electric fan, or the like. In addition, it is possible to use the axial flow fan 100 as an air-sending device that sends a fluid such as air.

By using the axial flow fan 100 according to Embodiments 1 to 4 as such a device, it is possible to achieve a decrease in noise and improvement of the air-sending efficiency of the air-sending device.

The axial flow fan 100 according to Embodiments 1 to 4 is (1) an axial flow fan including a plurality of blades 2, each of the blades 2 including: a leading edge 21 formed in front in a direction of rotation RT of the axial flow fan; an inner circumferential edge 24 formed at an inner circumference of the blades 2; and an outer circumferential edge 23 formed at an outer circumference of the blades 2, the outer circumferential edge 23 being located in more downstream in a flow direction of a fluid, forced to flow by the axial flow fan, than the inner circumferential edge 24, the blade 2 being reflexed toward upstream of the flow direction at a portion adjacent to the outer circumferential edge 23, and having a local angle-decrease section 10 having a blade inlet angle α at the leading edge 21 decreasing from neighborhood, the local angle-decrease section 10 being formed at a side of the leading edge 21 and being located closer to the outer circumferential edge 23 than to the inner circumferential edge 24.

Thus, by providing the local angle-decrease section 10 having the blade inlet angle α decreasing from neighborhood so as to be smaller than the blade inlet angle α of the inner circumferential side leading edge 11, the local angle-decrease section 10 being formed at the side of the blade 2 and located closer to the outer circumferential edge 23 at which there is influence of the blade edge eddy 3, it is possible to make the main air current angle α' and the inflow angle β substantially equal to each other as shown in FIG. 4. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(2) In the axial flow fan 100 described in (1), the local angle-decrease section 10 has, at the leading edge 21 of the local angle-decrease section 10, the minimum point B at which the blade inlet angle α has a minimum.

Thus, the position at which the eddy diameter of the blade edge eddy 3 is the maximum value Lmax and the position at which the blade inlet angle α has the minimum substantially coincide with each other.

Therefore, even at the radial length R of the blade 2 at which the eddy diameter of the blade edge eddy 3 is the maximum value Lmax, it is possible to make the main air current angle α' and the inflow angle β shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(3) In the axial flow fan 100 described in (2), the local angle-decrease section 10 has the intermediate point D located at an intermediate position between both ends of the local angle-decrease section 10, and the minimum point B is formed on a rotation axis RC side of the intermediate point D.

That is, by making the blade inlet angle α have a minimum at the radial length R=Rs that is smaller than the radial length R=Rm at the intermediate point D, the position at which the eddy diameter of the blade edge eddy 3 is the maximum value Lmax and the position at which the blade inlet angle α has the minimum substantially coincide with each other.

Therefore, even at the radial length R of the blade 2 at which the eddy diameter of the blade edge eddy 3 is the maximum value Lmax, it is possible to make the main air current angle α' and the inflow angle β shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(4) In the axial flow fan 100 described in (2), the axial flow fan 100 includes the cylindrical boss portion 1 around the rotation axis RC, and the radial length Rs that is the distance between the rotation axis RC and the minimum point B satisfies $0.1<(Rt-Rs)/(Rt-Rb)<0.5$ when: the radial length that is the distance from the rotation axis RC to the outer circumferential surface of the boss portion 1 is denoted by Rb; and the maximum radial length from the rotation axis RC to the outer circumferential edge 23 is denoted by Rt.

Thus, the range of the local angle-decrease section 10 in which the blade inlet angle α decreases substantially coincides with the position at which the blade edge eddy 3 occurs.

Therefore, it is possible to make the main air current angle α' of the main air current F3' and the inflow angle β of the blade 2 shown in FIG. 4 substantially equal to each other. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(5) In the axial flow fan 100 described in (1) to (4), the local angle-decrease section 10 is formed within half the length at the outer circumferential edge 23 side, of the radial length of the leading edge 21, and the blade inlet angle α of the local angle-decrease section 10 is formed as a value smaller than the blade inlet angle α at the inner circumference side relative to the local angle-decrease section 10.

Thus, by providing the local angle-decrease section 10 having the blade inlet angle α decreasing from neighborhood so as to be smaller than the blade inlet angle α of the inner circumferential side leading edge 11, the local angle-decrease section 10 being formed at the side of the blade 2 and located closer to the outer circumferential edge 23 at which there is influence of the blade edge eddy 3, it is possible to make the main air current angle α' and the inflow angle β substantially equal to each other as shown in FIG. 4. Accordingly, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(6) In the axial flow fan 100 described in (1) to (5), the plurality of blades 2 each have an arc cross-sectional shape in a blade chord direction.

(7) In the axial flow fan 100 described in (6), the blade inlet angle α satisfies $\alpha=\gamma+\theta c/2$ when: the angle formed by the rotation axis RC and the blade chord 27 connecting the leading edge 21 and the trailing edge 22 formed in back in the direction of rotation is referred to as stagger angle γ; and the acute angle at the point of intersection of a tangent line at the leading edge 21 and a tangent line at the trailing edge 22 is referred to as camber angle θc.

Thus, the surface of the blade 2 becomes smooth, so that the blade edge eddy 3 generated at the suction surface 2*b* of the blade 2 becomes stable. Accordingly, as shown in FIG. 4, the main air current F3' flowing in from the leading edge 21 of the blade 2 becomes stable on the blade edge eddy 3, and pressure loss is reduced, whereby it is possible to achieve a decrease in noise and an increase in efficiency of the axial flow fan 100.

(8) The axial flow fan 100 described in (1) to (7) is applied to an air-conditioning apparatus.

In this case, the air-sending efficiency of the condenser fan 52*a* or the evaporator fan 53*a* improves, so that it is possible to improve the cooling/heating performance of the air-conditioning apparatus.

REFERENCE SIGNS LIST

1 boss portion 2 blade 2*a* pressure surface 2*b* suction surface 3 blade edge eddy 3*a* center of blade edge eddy 10 local angle-decrease section 11 inner circumferential side leading edge 21 leading edge 21*a* leading edge tangent line 21*a*' inflow direction of main air current F3' 22 trailing edge 22*a* trailing edge tangent line 23 outer circumferential edge 24 inner circumferential edge 26 outer circumference reflexed portion 27 blade chord 50 refrigeration cycle device 51 compressor 52 condenser 52*a* condenser fan 53 evaporator 53*a* evaporator fan 54 expansion valve 100 axial flow fan A first point of intersection Am first maximum point B minimum point C second point of intersection Cm second maximum point D intermediate point F1 flow direction of fluid F2 inflow air current F3 main air current F3' main air current Lmax maximum value of eddy diameter of blade edge eddy P radial direction ratio RC rotation axis RC' axial imaginary line RT direction of rotation a blade inlet angle α' main air current angle α1 blade inlet angle of inner circumferential side leading edge α2 blade inlet angle of local angle-decrease section β inflow angle γ stagger angle θc camber angle

The invention claimed is:

1. An axial flow fan comprising:

a plurality of blades, each of the blades including a leading edge formed in front in a direction of rotation of the axial flow fan, an inner circumferential edge formed at an inner circumference of the blades, and an outer circumferential edge formed at an outer circumference of the blades, the outer circumferential edge being located at downstream in a flow direction of a fluid, forced to move by the axial flow fan, than the inner circumferential edge, the blade being reflexed toward upstream of the fluid at a portion adjacent to the outer circumferential edge, and having a local angle-decrease section having a blade inlet angle at the leading edge decreasing from neighborhood, the local angle-decrease section being formed at a side of the leading edge and being located closer to the outer circumferential edge than to the inner circumferential edge, the local angle-decrease section having, at a leading edge of the local angle-decrease section, a minimum point at which the blade inlet angle is a minimum, the local angle-decrease section having an intermediate point located at an intermediate position between both ends of the local angle-decrease section, the minimum point being formed closer to a rotation axis than the intermediate point.

2. The axial flow fan of claim 1 further comprising a cylindrical boss portion around a rotation axis, wherein a radial length Rs that is a distance between the rotation axis and the minimum point satisfies $$0.1<(Rt-Rs)/(Rt-Rb)<0.5,$$

where a radial length that is a distance from the rotation axis to an outer circumferential surface of the boss portion is Rb, and a maximum radial length from the rotation axis to the outer circumferential edge is Rt.

3. The axial flow fan of claim 1, wherein the local angle-decrease section is formed within half a length at a side of the outer circumferential edge, of a radial length of the leading edge, and the blade inlet angle of the local angle-decrease section is smaller than the blade inlet angle at an inner circumference side relative to the local angle-decrease section.

4. The axial flow fan of claim 1, wherein the plurality of blades each have an arc cross-sectional shape in a blade chord direction.

5. The axial flow fan of claim 4, wherein the blade inlet angle satisfies $$\alpha=\gamma+\theta c/2,$$

where the blade inlet angle is denoted by $\alpha$, an angle formed by a rotation axis and a blade chord connecting the leading edge and a trailing edge formed in back in the direction of rotation is referred to as stagger angle $\gamma$, and an acute angle at a point of intersection of a tangent line at the leading edge and a tangent line at the trailing edge is referred to as camber angle $\theta c$.

6. An air-conditioning apparatus comprising the axial flow fan of claim 1.

* * * * *